US009898023B2

(12) United States Patent
Inagi et al.

(10) Patent No.: US 9,898,023 B2
(45) Date of Patent: Feb. 20, 2018

(54) POWER MANAGEMENT METHOD, POWER MANAGEMENT SERVER, AND OFFICE MACHINE FOR MANAGING ELECTRIC POWER

(71) Applicants: KABUSHIKI KAISHA TOSHIBA, Minato-ku, Tokyo (JP); TOSHIBA TEC KABUSHIKI KAISHA, Shinagawa-ku, Tokyo (JP)

(72) Inventors: Tatsuya Inagi, Tokyo-to (JP); Yoshikatsu Kamisuwa, Tokyo-to (JP); Makoto Yasuhira, Kanagawa-ken (JP); Shigenori Fujiwara, Kanagawa-ken (JP)

(73) Assignees: TOSHIBA TEC KABUSHIKI KAISHA, Tokyo (JP); KABUSHIKI KAISHA TOSHIBA, Tokyo (JP)

( * ) Notice: Subject to any disclaimer, the term of this patent is extended or adjusted under 35 U.S.C. 154(b) by 577 days.

(21) Appl. No.: 14/072,044

(22) Filed: Nov. 5, 2013

(65) Prior Publication Data

US 2015/0127182 A1 May 7, 2015

(51) Int. Cl.
*G05F 1/66* (2006.01)

(52) U.S. Cl.
CPC ..... *G05F 1/66* (2013.01)

(58) Field of Classification Search
CPC ..... G05F 1/66
USPC ..... 700/295
See application file for complete search history.

(56) References Cited

U.S. PATENT DOCUMENTS 8,112,520 B2 * 2/2012 Mizuno ..... G06F 1/3203 365/221
2004/0066171 A1 * 4/2004 Mori ..... G06F 1/263 320/132
2005/0096797 A1 * 5/2005 Matsubara ..... H02J 3/00 700/291
2005/0102674 A1 * 5/2005 Tameshige ..... G06F 9/5011 718/100
2007/0280708 A1 12/2007 Kamisuwa et al.
(Continued)

FOREIGN PATENT DOCUMENTS

JP 2002-292973 10/2002

*Primary Examiner* — Christopher E Everett
(74) *Attorney, Agent, or Firm* — Amin, Turocy & Watson LLP

(57) ABSTRACT

According to one embodiment, there is provided a power management method for connecting a server to office machines to control electric power of the office machines. The office machines respectively store machine side power plans, which are operation states with respect to transition times. The server stores server side power plans of the office machines and subjects electric powers of the office machines to management control. The power management method includes comparing the server side power plan stored in the server and the machine side power plan stored in the office machines, comparing, when an operation state based on the server side power plan and an operation state based on the machine side power plan are different, power consumptions in the operation state based on the server side power plan and an operation state based on the machine side power plan, and changing an operation state of the office machine to be an operation state with small power consumption.

4 Claims, 10 Drawing Sheets

OPERATION-STATE GRASPING UNIT 105

| MACHINE ID | MACHINE SIDE PLAN | SERVER SIDE PLAN |
|---|---|---|
| 13a | POWER SAVE | POWER SAVE |
| 13b | POWER SAVE | SLEEP |
| 13c | SLEEP | SLEEP |
| 14a | POWER-OFF | POWER-OFF |
| 14b | POWER SAVE | POWER-OFF |

(56) References Cited

U.S. PATENT DOCUMENTS

| | | | | |
|---|---|---|---|---|
| 2009/0204833 | A1* | 8/2009 | Brown | G06F 1/3203 713/323 |
| 2010/0063643 | A1* | 3/2010 | Boss | G06Q 50/06 700/291 |
| 2010/0175719 | A1* | 7/2010 | Finch | G06Q 50/06 134/18 |
| 2011/0166719 | A1* | 7/2011 | Pasek | G01D 4/00 700/291 |
| 2011/0320795 | A1* | 12/2011 | Bosisio | G06F 1/3287 713/1 |
| 2012/0073603 | A1* | 3/2012 | Graven | A47L 15/0047 134/18 |
| 2012/0254851 | A1* | 10/2012 | Diab | H04L 41/12 717/171 |
| 2012/0277921 | A1* | 11/2012 | Shaffer | G06Q 50/06 700/291 |

* cited by examiner

FIG. 3

SERVER-PLAN STORING UNIT 33

| PLAN ID: SC1 | |
|---|---|
| TRANSITION TIME | OPERATION STATE |
| 8:30 | POWER SAVE |
| 12:00 | SLEEP |
| 13:00 | POWER SAVE |
| 17:00 | POWER-OFF |
| 17:30 | SLEEP |

FIG. 4

MACHINE-PLAN ALLOCATING UNIT 34

| MACHINE ID | PLAN ID |
|---|---|
| 13a | SC1 |
| 13b | SC1 |
| 13c | SC2 |
| 14a | SC3 |
| 14b | SC4 |

FIG. 5

OPERATION-STATE GRASPING UNIT 105

| MACHINE ID | MACHINE SIDE PLAN | SERVER SIDE PLAN |
|---|---|---|
| 13a | POWER SAVE | POWER SAVE |
| 13b | POWER SAVE | SLEEP |
| 13c | SLEEP | SLEEP |
| 14a | POWER-OFF | POWER-OFF |
| 14b | POWER SAVE | POWER-OFF |

FIG. 6

MACHINE-ADDRESS MANAGING UNIT 36

| MACHINE ID | MACHINE ADDRESS |
|---|---|
| 13a | xxx···.xxx |
| 13b | xxx.xxx.yyy |
| 13c | yyy. yyy. zzz |
| 14a | SC3 |
| 14b | SC4 |

FIG. 7

MACHINE-MODEL STORING UNIT 37

| MACHINE ID | MODEL NAME |
|---|---|
| 13a | MODEL 1 |
| 13b | MODEL 2 |
| 13c | MODEL 1 |
| 14a | MODEL 3 |
| 14b | MODEL 4 |

FIG. 8

MODEL-POWER-CONSUMPTION STORING UNIT 38

| MODEL NAME: MODEL 1 | |
|---|---|
| OPERATION STATE | CONSUMPTION (W) |
| POWER SAVE | 100 |
| SLEEP | 50 |
| POWER-OFF | 0 |

MACHINE-PLAN STORING UNIT 103

| MACHINE ID: 13a | |
|---|---|
| TRANSITION TIME | OPERATION STATE |
| 8:30 | POWER SAVE |
| 12:00 | SLEEP |
| 13:00 | POWER SAVE |
| 17:00 | POWER-OFF |

FIG. 11

OPERATION-STATE GRASPING UNIT 105

| MACHINE ID | MACHINE SIDE PLAN | SERVER SIDE PLAN |
|---|---|---|
| 13a | POWER SAVE | SLEEP |

FIG. 12

POWER-MANAGEMENT-SERVER-ADDRESS MANAGING UNIT 106

| MACHINE ID | IP ADDRESS OF POWER MANAGEMENT SERVER |
|---|---|
| 13a | xxx···.xxx |

FIG. 13

MACHINE-POWER-CONSUMPTION STORING UNIT 108

| MACHINE ID: 13a | |
|---|---|
| OPERATION STATE | POWER CONSUMPTION (W) |
| POWER SAVE | 100 |
| SLEEP | 50 |
| POWER-OFF | 0 |

POWER MANAGEMENT METHOD, POWER MANAGEMENT SERVER, AND OFFICE MACHINE FOR MANAGING ELECTRIC POWER

FIELD

Embodiments described herein relate generally to a power management method and a power management server for managing schedules (hereinafter also referred to as plans) of operation state transitions of devices such as a computer and an image forming apparatus and an office machine for managing electric power.

BACKGROUND

Among personal computers and MFPs, there is a device including a function of transitioning an operation state according to a schedule set inside the device in order to suppress power consumption during standby and a function of transitioning an operation state according to a schedule set in a management apparatus by a system administrator according to a policy such as power saving of a company or the like.

However, when the schedules are set both inside the device and in the management apparatus, during transition of a device operation state corresponding to the schedule of the management apparatus, the device operation state also transitions even if power consumption is higher in a transition planned operation state in the management apparatus schedule than in the present operation state of the device that transitioned beforehand according to the schedule inside the device.

The related art is described in JP-A-2002-292973.

DESCRIPTION OF THE DRAWINGS

FIG. 3 is a diagram showing an example of operation states stored in a server-plan storing unit of a power management server;

FIG. 4 is a diagram showing an example of power plans stored in a machine-plan allocating unit of the power management server;

FIG. 5 is a diagram showing a comparative example of operation states stored in an operation-state grasping unit of the power management server;

FIG. 6 is a diagram showing an example of machine addresses of office machines stored in a machine-address managing unit of the power management server;

FIG. 7 is a diagram showing a correspondence relation example between office machines and model names of the office machines stored in a machine-model storing unit of the power management server;

FIG. 8 is a diagram showing a relation between operation states and power consumptions in the operation states stored in a model-power-consumption storing unit of the power management server;

FIG. 11 is a diagram showing a comparative example of between operation states on a machine side and a server side stored in an operation-state grasping unit of the MFP;

FIG. 12 is a diagram showing a relation of a machine address of a power management server office machine stored in a power-management-server-address managing unit of the MFP;

FIG. 13 is a diagram showing a correspondence relation between operation states and power consumptions stored in a machine-power-consumption storing unit of the MFP;

DETAILED DESCRIPTION

It is an object of embodiments to provide a power management method, a power management server, and an office machine for managing electric power that can always save electric power in a system including a server and an office machine.

In general, according to one embodiment, there is provided a power management method for connecting a server to office machines to control electric power of the office machines, the office machines respectively storing machine side power plans, which are operation states with respect to transition times, and the server storing server side power plans of the office machines and subjecting electric powers of the office machines to management control, the power management method including: comparing the server side power plan stored in the server and the machine side power plan stored in the office machines; comparing, when an operation state based on the server side power plan and an operation state based on the machine side power plan are different, power consumptions in the operation state based on the server side power plan and an operation state based on the machine side power plan; and changing an operation state of the office machine to be an operation state with small power consumption. The server that subjects the electric powers of the office machines to the management control is connected to one or a plurality of office machines that respectively store the machine side power plans, which are operation states with respect to transition times, to control the electric power of the office machine. The server side power plan stored in the server and the machine side power plan stored in the office machine are compared. If operation states based on both the plans are different, an operation state of the office machine is changed to be an operation state with small power consumption corresponding to the operation states.

Embodiments are explained below with reference to the drawings.

Figure 1:
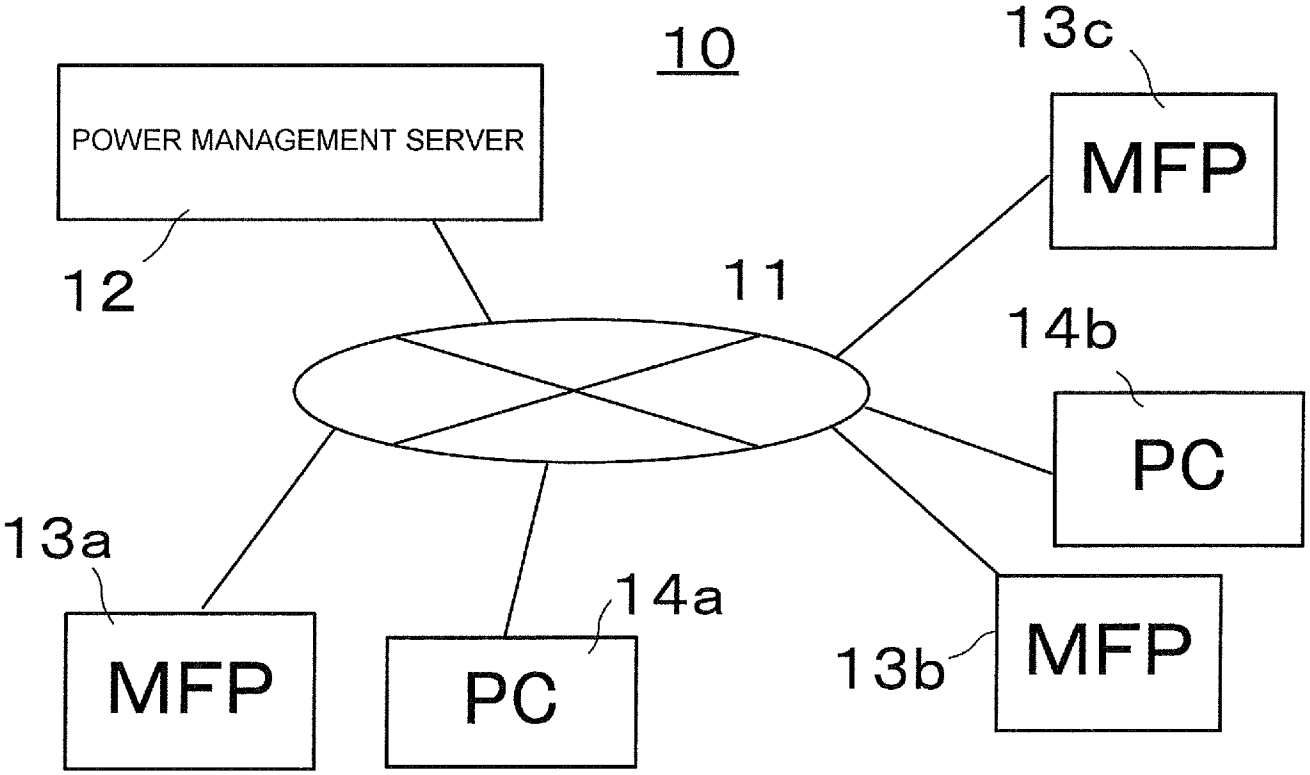
FIG. 1 is a diagram showing a system configuration example of an embodiment.

An overall diagram of a power management system in an embodiment is shown in FIG. 1. This power management system 10 includes a plurality of office machines connected to a network 11 and a power management server 12 configured to control electric powers of the office machines according to a power schedule. The office machines are multi-functional peripherals (MFPs) and personal computers (PCs). The network 11 may be an intranet or connection via the Internet.

In an example in this embodiment, two MFPs 13*a* and 13*b* and two PCs 14*a* and 14*b* are connected to the network 11 and can perform communication with each other. The number of office machines may be more or less than that number. Besides, the office machines may be POS (Point Of Sales) machines. The power management server 12 includes a power schedule and has a function of managing the power schedules of the office machines. However, the power management server 12 may also have other server functions.

Figure 2:
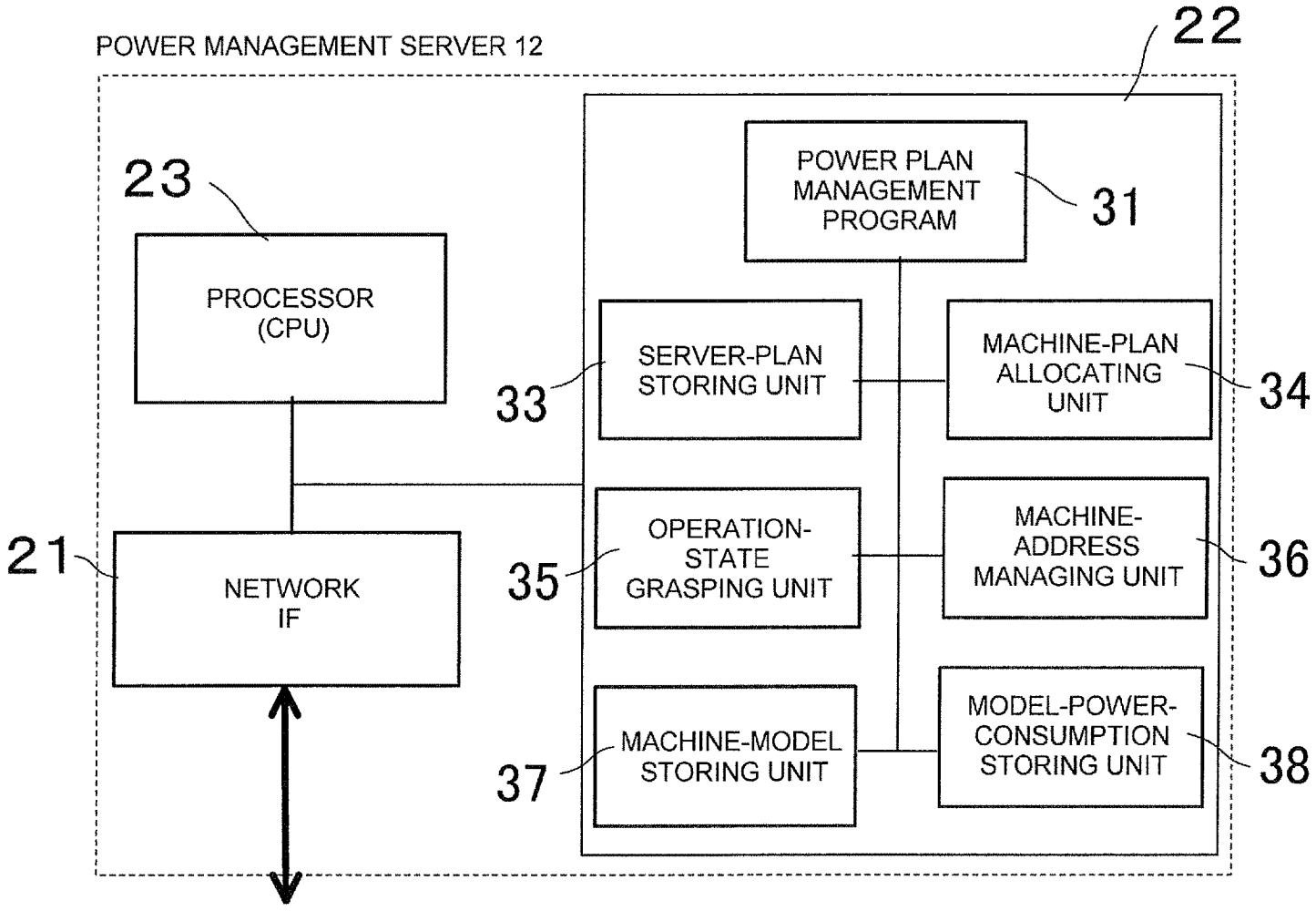
FIG. 2 is a diagram showing a configuration example in a system shown in FIG. 1.

A configuration example of the power management server 12 in this embodiment is shown in FIG. 2. The power management server 12 includes a network interface (IF) 21 configured to perform transmission and reception of data to and from the outside via a network, a storage device 22 configured to store various data, and a processor (a CPU) 23 configured to control the power management server 12, the network IF 21, and the storage device 22. The processor 23 performs communication with the office machines via the network IF 21.

The storage device 22 includes a power plan (schedule) management program 31 executed by the CPU 23, a server-plan storing unit 33 having stored therein an operation state from transition time for each of schedules, a machine-plan allocating unit 34 configured to store schedules allocated to the office machines, an operation-state grasping unit 35 configured to grasp operation states based on the schedules of the office machines and operation states based on schedules for the office machine in a server, a machine-address managing unit 36 configured to store addresses of the office machines, a machine-model storing unit 37 configured to store a correspondence relation between the office machines and model names of the machines, and a model-power-consumption storing unit 38 configured to store operation states in models and power consumptions in the operation states.

The office machines are specified by machine IDs. The schedules are specified by plan IDs. In this example, the machine IDs are set the same as signs of the office machines. For example, a machine ID of an MFP 13*a* is 13*a*. The same applies to the other office machines.

An example of operation states with respect to transition times in a specific plan ID stored in the server-plan storing unit 33 is shown in FIG. 3. In this example, the plan ID is SC1 and this schedule changes to a power saving mode at 8:30, changes to a sleep state at 12:00, and changes to the power saving mode again at 13:00. Subsequently, the schedule changes to power-off at 17:00 and changes to the sleep state at 17:30 in SC1. This is the schedule, the plan ID of which is SC1. There are other plan IDs as well.

An example of a relation between machine IDs of the office machines stored in the machine-plan allocating unit 34 and plan IDs allocated to the machines is shown in FIG. 4. A schedule, the plan ID of which is SC1, is allocated to the MFP 13*a*, the machine ID of which is 13*a*. A schedule, the plan ID of which is SC1, is allocated to an MFP 13*b*, the machine ID of which is 13*b*.

A schedule, the plan ID of which is SC2, is allocated to an MFP 13*c*, the machine ID of which is 13*c*. A schedule, the plan ID of which is SC3, is allocated to a PC 14*a*, the machine ID of which is 14*a*. A schedule, the plan ID of which is SC4, is allocated to a PC 14*b*, the machine ID of which is 14*b*.

An example of operation states based on machine side schedules of the office machines and operation states based on server side schedules stored in the operation-state grasping unit 35 is shown in FIG. 5. For the machine IDs 13*a*, 13*c*, and 14*a*, the operation states of the schedules on the machine side and the server side coincide with each other. However, the operation states of the schedules for the machine IDs 13*b* and 14*b* are different between the machine side and the server side.

An example of a correspondence relation between the office machines and addresses of the machines stored in the machine-address managing unit 36 is shown in FIG. 6. Machine IDs are the machine IDs (having the same signs) of the MFPs 13*a*, 13*b*, and 13*c* and the PCs 14*a* and 14*b* shown in FIG. 1. Machine addresses such as IP addresses are stored with respect to the machine IDs.

An example of a correspondence relation between the office machines and models of the machines stored in the machine-model storing unit 37 is shown in FIG. 7. This example indicates that the MFPs 13*a* and 13*c* are a model 1, the MFP 13*b* is a model 2, the PC 14*a* is a model 3, and the PC 14*b* is a model 4.

An example of operation states in the models and power consumptions in the operation states stored in the model-power-consumption storing unit 38 is shown in FIG. 8. This example indicates that, in the case of the model 1, when the operation state is a power saving mode, the power consumption is 100 W, when the operation state is a sleep mode, the power consumption is 50 W, and, when the operation state is power-off, the power consumption is zero.

Figures 9, 10:
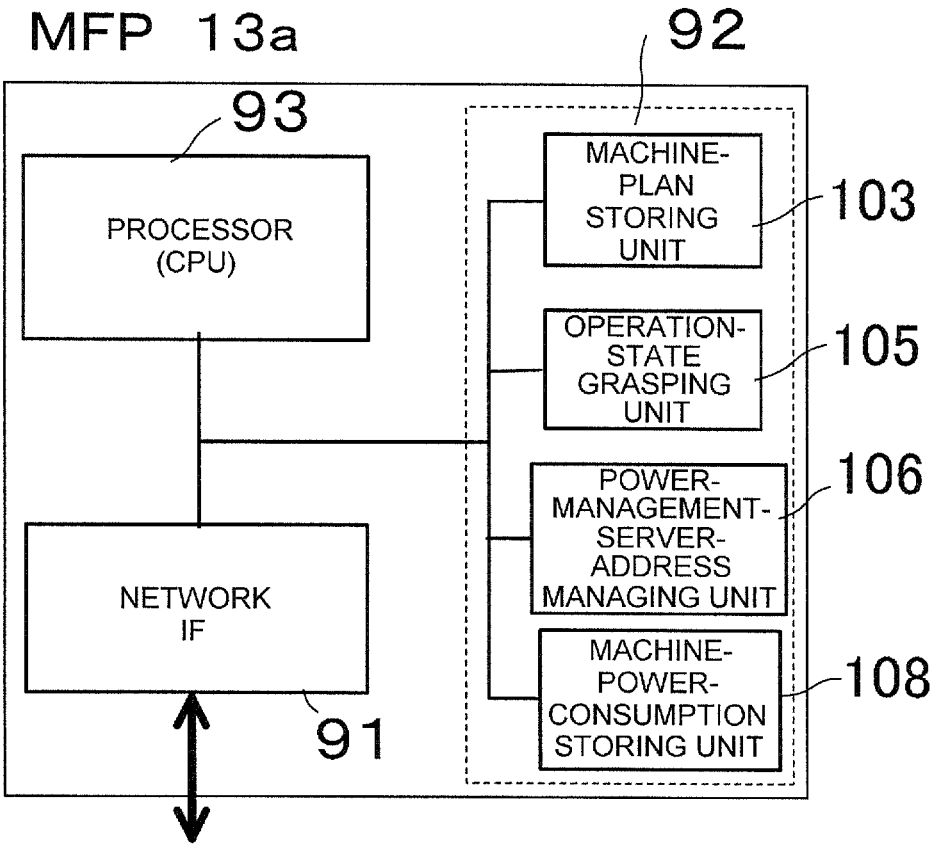
FIG. 9 is a diagram showing a configuration example of an MFP in the system shown in FIG. 1.
FIG. 10 is a diagram showing a relation between transition times and operation states stored in a machine-plan storing unit of the MFP.

A configuration example of an office machine is shown in FIG. 9. In this example, the MFP 13*a* is explained as an example. The MFP 13*a* includes a network interface (IF) 91 configured to perform transmission and reception of data to and from the outside via a network, a storage device 92 configured to store various data, and a processor (CPU) 93 configured to control the network IF 91 and the storage device 92. The processor 93 controls and performs communication of the MFP 13*a* with the server 12 via the network IF 91.

The storage device 92 includes a machine-plan storing unit 103 having stored therein operation states from transition times, an operation-state grasping unit 105 configured to grasp an operation state based on a schedule on the office machine side and an operation state based on a schedule for the office machine on the server side, a power-management-server-address managing unit 106 configured to store an address of a power management server office machine, and a machine-power-consumption storing unit 108 configured to store operation states in the office machines and power consumptions in the operation states.

An example of the operation states from the transition times stored in the machine-plan storing unit 103 is shown in FIG. 10. In this example, the office machine (the MFP 13*a*), the machine ID of which is 13*a*, enters the power saving mode at 8:30 and enters the sleep mode at 12:00. Thereafter, the office machine changes to the power saving mode at 13:00 and changes to the power-off state at 17:00.

An example of the operation state based on the schedule on the office machine side and the operation state based on the schedule for the office machine on the server side stored in the operation-state grasping unit 105 is shown in FIG. 11. In this example, when the MFP 13*a* is in the power saving mode in the schedule on the machine side, the MFP 13*a* is in the sleep mode in the schedule on the server side.

An example of an IP address of a power management server (in this case, the power management server 12) stored in the power-management-server-address managing unit 106 is shown in FIG. 12.

An example of an operation state in the office machine 13*a* and power consumption in the operation state stored in the machine-power-consumption storing unit 108 is shown in FIG. 13. In this example, power consumption in the power saving mode is 100 W and power consumption in the sleep mode is 50 W. When the operation state changes to the power-off, the power consumption decreases to zero.

When not only the power management server but also the office machines include the power plans in this way, there is an advantage that it is possible to perform, for example, finely specified limitations of electric power corresponding to a district, for example, in a lunch break only in a specific district.

First Embodiment

Figure 14:
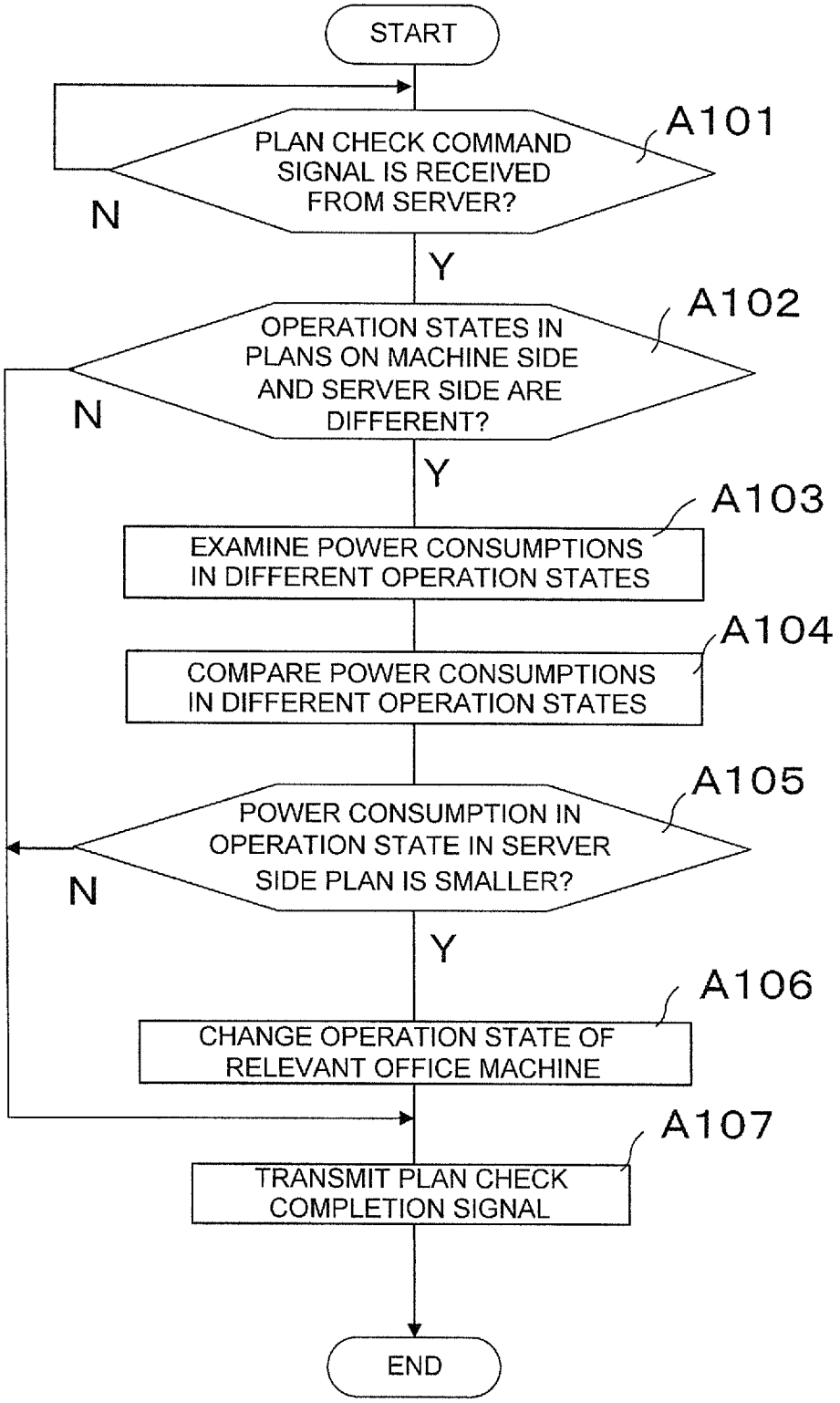
FIG. 14 is a diagram showing a flowchart example for explaining the operation of the office machine performed when the MFP functioning as the office machine compares operation states of power plans.
Figure 15:
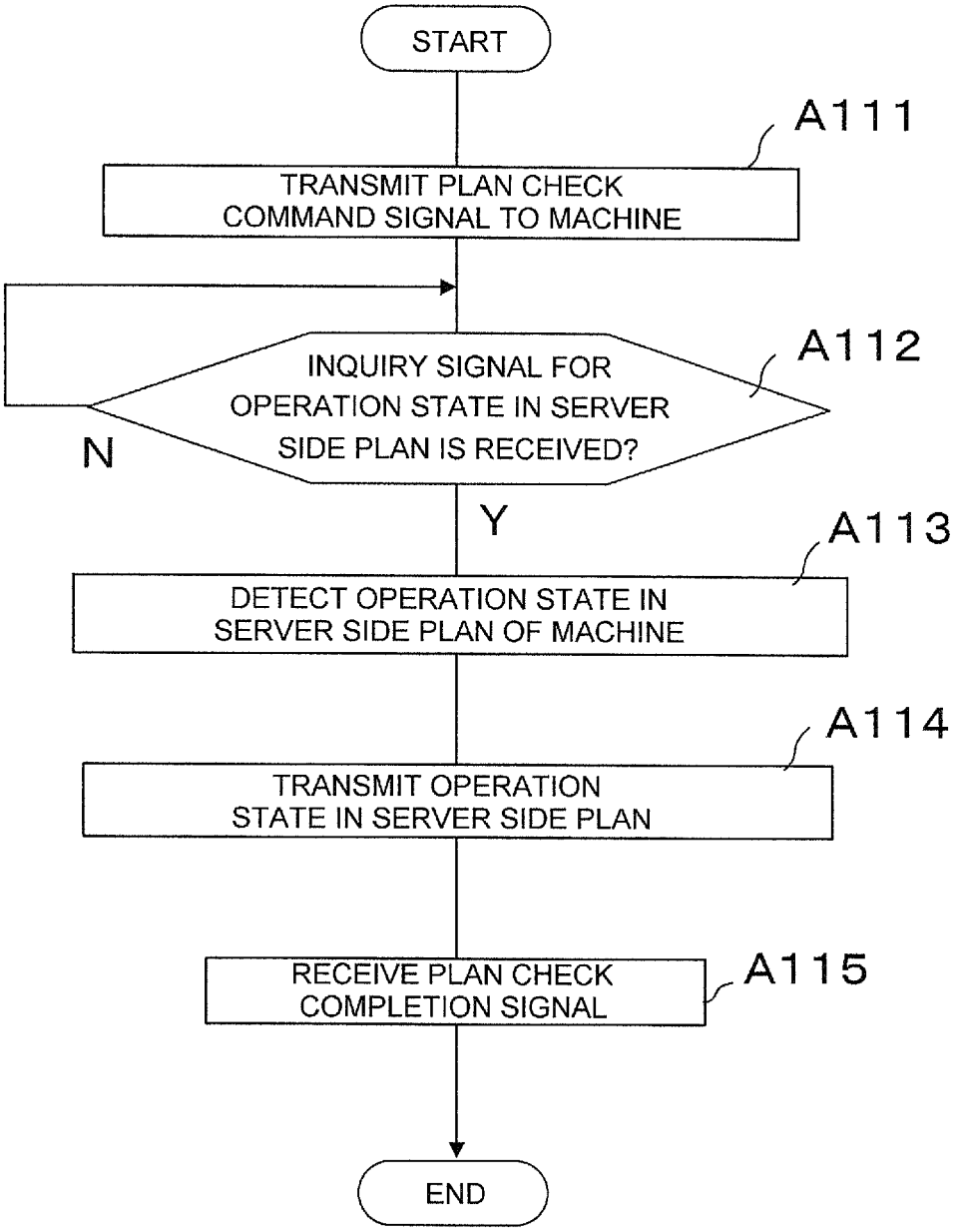
FIG. 15 is a diagram showing a flowchart example for explaining the operation of the power management server performed when the MFP compares operation states of power plans.

The operation of a first embodiment of the configuration explained above is explained on the basis of a flowchart on the machine side shown in FIG. 14 and a flowchart on the server side shown in FIG. 15. This example is an example of a form in which a comparison of power consumptions of the power management server and the office machine is performed on the office machine side. The operation in the office machine, for example, the MFP 13*a* is shown.

First, as shown in FIG. 15, in A111, the processor 23 of the power management server 12 transmits a plan check command signal to the MFP 13*a*, which is the office machine, via the network IF 21.

In A101 shown in FIG. 14, the processor 93 of the MFP 13*a* recognizes whether the plan check command signal transmitted from the power management server 12 is received. The processor 93 performs this operation by recognizing the signal input via the network IF 91.

When it is recognized in A101 that the plan check command signal is received, in the next A102, the processor 93 checks an operation state on the office machine side and an operation state on the server side at the point of time. The operation state of the MFP 13*a* is obtained from the machine-plan storing unit 103.

The operation state of the power management server 12 is obtained by the processor 93 transmitting an operation state inquiry signal in a server side plan from the MFP 13*a* to the power management server 12. In A112, the processor 23 of the power management server 12 detects whether the operation state inquiry signal is received from the MFP 13*a*.

If the operation state inquiry signal is received (Y in A112), the processor 23 accesses the server-plan storing unit 33 of the storage device 22 and detects an operation state of the server side plan of the MFP 13*a* (A113). The processor 23 transmits the operation state in the server side plan to the MFP 13*a* (A114).

A result of the detection of the operation state is represented, for example, as shown in FIG. 11. In an example shown in FIG. 11, the operation state is the power saving mode in the machine side plan and is the sleep mode in the server side plan. Therefore, the operation states are different.

In A102, the processor 93 of the MFP 13*a* recognizes that the operation state on the office machine side and the operation state on the server side are different. Then, in A103, the processor 93 examines power consumptions in the respective different operation states.

The processor 93 performs the examination of the power consumption by checking contents of the machine-power-consumption storing unit 108 and the machine-model storing unit 37 and the model-power-consumption storing unit 38 of the power management server 12. Actually, the processor 93 requests, via the network IF 91, the power management server 12 to check a value of power consumption in the sleep mode. In response to the request, the processor 23 of the power management server 12 checks a model of the requesting office machine from the machine-model storing unit 37 and further checks, from the model-power-consumption storing unit 38, a value of power consumption in the case of the sleep mode in the model. In the present case, it is discriminated that the MFP 13*a* is the model 1 according to FIG. 7 and the power consumption in the sleep mode in the case of the model 1 is 50 W according to FIG. 8.

On the other hand, as shown in FIG. 11, a state of the MFP 13*a* is the power saving mode in the machine side plan. The processor 93 examines the machine-power-consumption storing unit 108 and discriminates that, as shown in FIG. 13, a value of the power consumption is 100 W in the power saving mode. In A104, the processor 93 recognizes and compares the values of the power consumptions in the power saving mode and the sleep mode.

In the next A105, as a result of comparing the power consumptions in the resent operation state of the server side plan and the machine side plan, the processor 93 recognizes that the former is smaller.

Therefore, in A106, in the office machine, i.e., in the present case, the MFP 13*a*, the processor 93 issues a plan change command for a change to the sleep mode to thereby change the operation state of the office machine from the power saving mode to the sleep mode.

In the next A107, the processor 93 transmits a plan check completion signal to the power management server 12 and ends the processing.

If the operation states in the machine side plan and the server side plan are not different, i.e., are the same in A102 (N in A102), it is unnecessary to change the operation states. Therefore, the processor 93 shifts to A107, transmits the plan check completion signal to the power management server 12, and ends the processing.

If the power consumption in the operation state in the server side plan is equal to or larger than the power consumption in the operation state in the machine side plan in A105 (N in A105), it is unnecessary to change the operation state on the machine side. Therefore, the processor 93 also shifts to A107, transmits the plan check completion signal to the power management server 12, and informs the power management server 12 that the response to the plan check command signal ends. The processor 23 of the power management server 12 receives this signal (A115).

According to this embodiment, the present operation states in the office machine side plan and the server side plan are checked on the office machine side. Therefore, it is possible to perform power saving corresponding to states of the individual office machines.

Second Embodiment

Figure 16:
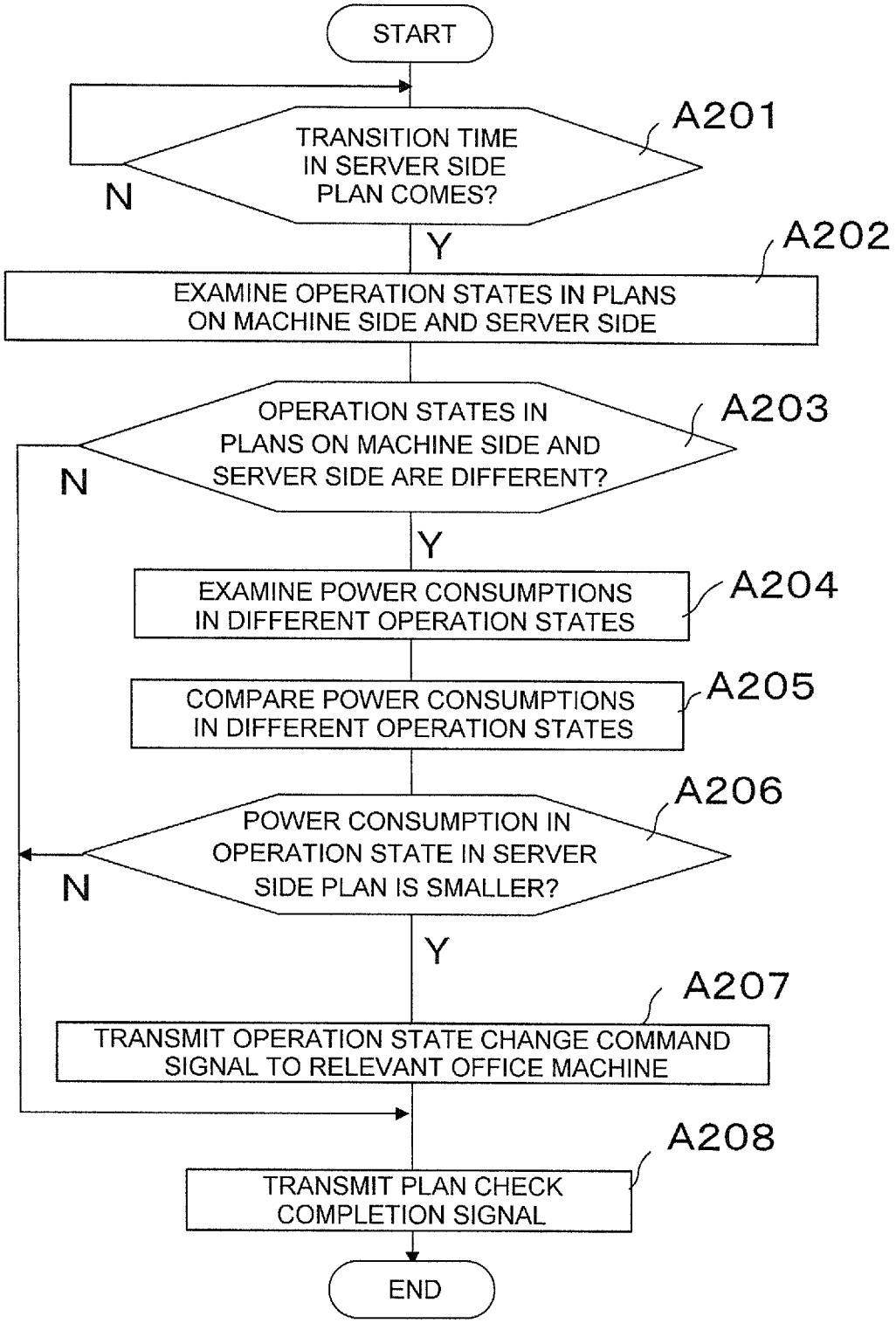
FIG. 16 is a diagram showing a flowchart example for explaining the operation of the power management server performed when the server compares operation states of power plans.

An embodiment in which the power management server 12 checks whether operation states are different is explained on the basis of a flowchart shown in FIG. 16.

This example is an example of a form in which a comparison of power consumptions of a power management server and an office machine is performed on a server side. The office machine is, for example, the MFP 13*a*.

First, in A201, the processor 23 of the power management server 12 checks a plan on the server side stored in the server-plan storing unit 33 of the storage device 22. Upon detecting that transition time comes, the processor 23 shifts to A202. The processor 23 obtains an operation state in the server side plan of the power management server 12 from the server-plan storing unit 33 of the storage device 22 shown in FIG. 2.

On the other hand, an operation state of a machine side plan in the MFP 13*a* is obtained from the machine-plan storing unit 103. Therefore, the processor 23 of the power management server 12 transmits an operation state inquiry signal in the machine side plan to the MFP 13*a* via the network IF 21. In the MFP 13*a*, the processor 93 grasps the present operation state from the operation-state grasping unit 105 and returns the operation state to the power management server 12 as an operation state response signal.

A result of the grasp of the operation state is represented, for example, as shown in FIG. 11. In an example shown in FIG. 11, the operation state is the power saving mode in the machine side plan and is the sleep mode in the server side plan. Therefore, the operation states are different.

In A203, the processor 23 of the power management server 12 recognizes that the operation state on the office machine side and the operation state on the server side are different. Then, in A204, the processor 23 examines power consumptions in the respective different operation states.

The processor 23 of the power management server 12 accesses the machine-model storing unit 37 of the storage device 22 and detects that the MFP 13*a* is the model 1 (see FIG. 7). Further, the processor 23 accesses the model-power-consumption storing unit 38 and detects that the power consumption is 50 W in the sleep mode of the model 1 (see FIG. 8).

On the other hand, the processor 23 transmits a power consumption inquiry signal in the power saving mode to the MFP 13*a* via the network IF 21. Upon receiving this signal, the processor 93 of the MFP 13*a* accesses the machine-power-consumption storing unit 108 and detects power consumption in the power saving mode.

As shown in FIG. 13, the power consumption in the power saving mode is 100 W. Therefore, the processor 93 of the MFP 13*a* transmits a response signal indicating that the power consumption is 100 W to the power management server 12 via the network IF 91.

In A205, the processor 23 compares the power consumptions obtained in this way. In this example, the power consumption in the sleep mode based on the server side plan is smaller than the power consumption in the power saving mode based on the machine side plan (Y in A206). Therefore, in A207, the processor 23 changes the operation state of the office machine from the power saving mode to the sleep mode.

Specifically, the processor 23 of the power management server 12 transmits an operation state change command signal to the MFP 13*a*. In the next A208, the processor 23 of the power management server 12 transmits a plan check completion signal to the MFP 13*a*.

If the power consumption in the operation state in the server side plan is equal to or larger than the power consumption in the operation state in the machine side plan in A206 (N in A206), it is unnecessary to change the operation state on the machine side. Therefore, in this case, the processor 23 of the power management server 12 also shifts to the A208, transmits the plan check completion signal to the MFP 13*a*, and informs the MFP 13*a* that the response to the plan check command ends.

In this embodiment, the power management server compares the power plan on the server side and the power plan on the office machine side and shifts the office machine to a mode with small power consumption. Therefore, it is possible to take a general view of the entire office machines and comprehensively save power.

In the example explained in the embodiment, a power management plan of the MFP functioning as the office machine is checked and compared. However, the same applies when a power management plan is checked concerning a PC.

In the embodiment, a schedule change from the server is explained. However, for example, a schedule change from a target machine may be performed.

The office machine in the embodiment is not limited to the MFP and the PC and can be applied to any machine included in the category of office machines such as a POS terminal.

In the example explained in the embodiment, a server side power plan stored in the power management server and a machine side power plan stored in the office machine are compared and, if an operation state based on the server side power plan and an operation state based on the machine side power plan are different, power consumptions of the operation state based on the server side power plan and the operation state based on the machine side power plan are compared and the operation state of the office machine is changed to an operation state with small power consumption. However, the operation state of the office machine may be directly changed to an operation state with smaller power consumption not via the two stages, i.e., the two operation states.

According to the embodiments, it is possible to obtain a power management method, a power management server, and an office machine for managing electric power that can always save electric power in a system including a server and an office machine.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A power management server that subjects electric power of an office machine to management control, the server comprising:

an interface unit for connecting the server to the office machine that stores a machine side power plan, the machine side power plan includes an operation state with respect to transition times;

a storing unit configured to store a server side power plan of the office machine that includes a second operation state with respect to the transition times, the server side power plan and the machine side power plan generated independently of each other;

a power-consumption comparing unit configured to compare, if it is detected by a power-plan comparing unit that the second operation state based on the server side power plan and the first operation state based on the machine side power plan are different, power consumptions in the second operation state based on the server side power plan and the first operation state based on the machine side power plan, the power-plan comparing unit configured to compare at the same time the first operation state and the second operation state, the power-plan comparing unit being set up on a side of the office machine; and an operation-state setting unit configured to: set the office machine to the first operation state when it is detected by the power-consumption comparing unit that a power consumption of the first operation state is less than a power consumption of the second operation state, and set the office machine to the second operation state when it is detected by the power-consumption comparing unit that the power consumption of the second operation state is less than the power consumption of the first operation state.

2. The power management server according to claim 1, wherein in the server side power plan, the second operation state is associated with a schedule, and the operation-state setting unit sets the office machine to the second operation state by allocating the schedule to the office machine.

3. An office machine for managing electric power, comprising:

an interface unit connecting the office machine to a server that stores a server side power plan that includes a first operation state with respect to a transition time, and the server subjects electric power of the office machine to management control;

a storing unit storing a machine side power plan, the machine side power plan and the server side power plan generated independently of each other;

a power-plan comparing unit configured to compare at the same time the first operation state based on the server side power plan stored in the server and a second operation state based on the machine side power plan stored in the office machine;

a power-consumption comparing unit configured to compare, if is detected by the power-plan comparing unit that the first operation state based on the server side power plan and the second operation state based on the machine side power plan are different, power consumptions in the first operation state based on the server side power plan and the second operation state based on the machine side power plan; and an operation-state setting unit configured to: set the office machine to the first operation state when it is detected by the power-consumption comparing unit that a power consumption of the first operation state is less than a power consumption of the second operation state, and set the office machine to the second operation state when it is detected by the power-consumption comparing unit that the power consumption of the second operation state is less than the power consumption of the first operation state.

4. The office machine according to claim 3, wherein in the server side power plan, the first operation state is associated with a schedule, and the operation-state setting unit sets the office machine to the first operation state by allocating the schedule to the office machine.

* * * * *